United States Patent [19]

Doerr et al.

[11] Patent Number: 4,681,252

[45] **Date of Patent: * Jul. 21, 1987**

[54] CARRYING HANDLE FOR CAN CARTON

[75] Inventors: Erwin Doerr, Dunwoody; Prentice J. Wood, Hapeville, both of Ga.

[73] Assignee: The Mead Corporation, Dayton, Ohio

[ * ] Notice: The portion of the term of this patent subsequent to Dec. 17, 2002 has been disclaimed.

[21] Appl. No.: 863,467

[22] Filed: May 15, 1986

[51] Int. Cl.[4] ..... B65D 5/46

[52] U.S. Cl. ..... 229/52 B; 206/141; 206/427

[58] Field of Search ..... 229/52 B, 40; 206/141, 206/427, 434

[56] References Cited

U.S. PATENT DOCUMENTS

| | | | |
|---|---|---|---|
| 2,598,051 | 5/1952 | Guyer et al. | 229/52 B |
| 2,718,301 | 9/1955 | Palmer | 229/52 B |
| 2,785,847 | 3/1957 | Forrer | 229/52 B |
| 3,696,990 | 10/1972 | Dewhurst | 229/52 B |
| 3,750,874 | 8/1973 | Detzel et al. | 229/40 |
| 3,994,432 | 11/1976 | Kirby, Jr. | 229/52 B |
| 4,405,078 | 9/1983 | Dutcher et al. | 229/52 B |
| 4,558,816 | 12/1985 | Wood | 229/52 B |

FOREIGN PATENT DOCUMENTS

| | | | |
|---|---|---|---|
| 1602857 | 11/1981 | United Kingdom | 229/52 B |

*Primary Examiner*—Stephen Marcus
*Assistant Examiner*—Gary E. Elkins
*Attorney, Agent, or Firm*—Rodgers & Rodgers

[57] ABSTRACT

A can carton having interconnected top, bottom and side walls and end closure panels is provided with a transverse flap formed in the top wall and including spaced parallel side edges and arcuate end slits interconnecting adjacent side edges of the flap, one of the side edges of the flap being defined by a perforated severance line and the other side edge of the flap being defined by a fold line together with stress relieving slits formed in the top and side walls which extend from each arcuate slit into the adjacent side wall. The point of intersection of the stress relieving slit in each side wall with the junction between each side and top wall is offset longitudinally from the severance line defining a side edge of the handle flap. According to a feature of the invention in one form each side edge of the handle flap may be defined by a perforated line which may function as a severance line or as a fold line.

7 Claims, 4 Drawing Figures

CARRYING HANDLE FOR CAN CARTON

TECHNICAL FIELD

This invention relates generally to can cartons and more particularly to carrying handles for such cartons.

BACKGROUND ART

U.S. Pat. No. 4,558,816 issued Dec. 17, 1985 and owned by the assignee of this invention discloses a carrying handle for a can carton which includes two identical and complementary handle flaps having coincidental edges and which are foldable inwardly in opposite directions.

DISCLOSURE OF THE INVENTION

According to this invention in one form, a can carton having interconnected top, bottom and side walls and end closure panels is provided with a carrying handle formed in the carton top wall and arranged in transverse relation thereto and including spaced side edges adjacent ends of which are interconnected by end slits together with stress relieving perforated slits extending from each end slit and across the fold line between the top wall and each side wall and into the adjacent side wall, one side edge of the transverse handle flap being defined by a perforated severance line and the opposite side edge of the handle flap being defined by a fold line. The point of intersection of the stress relieving slit in each side wall with the junction between each side and top wall is offset longitudinally from the severance line defining a side edge of the handle flap.

According to a feature of the invention, each side edge of the handle flap may be defined by a line which is specially arranged to function either as a severance line or as a fold line so that the handle flap may be folded in either of two opposite directions.

According to another feature of the invention, a medial transverse fold line may be formed in the handle panel if desired.

BEST MODE OF CARRYING OUT THE INVENTION

Figure 1:
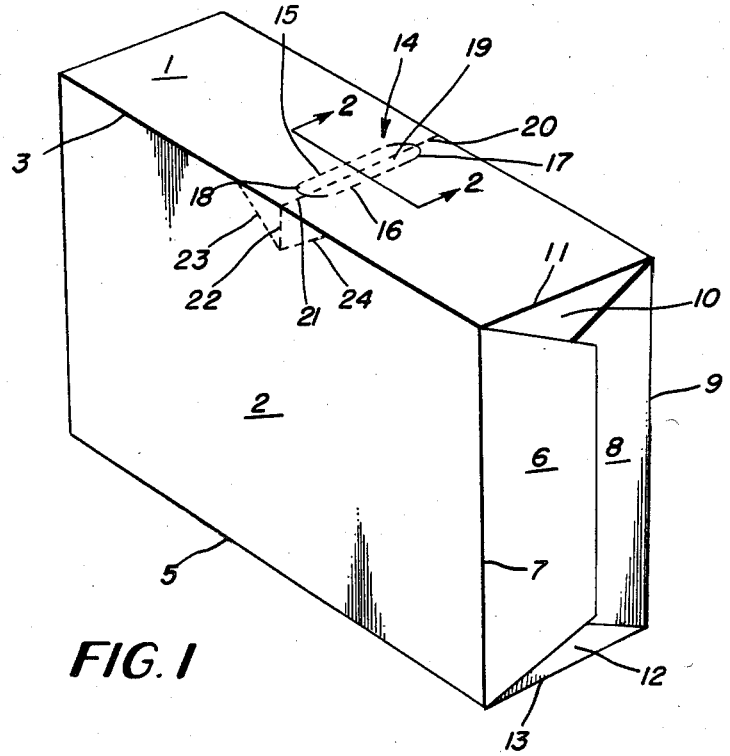
FIG. 1 is a perspective view of a loaded set up can carton which embodies the handle structure of this invention.

With reference to FIG. 1 the can carton includes a top wall designated by the numeral 1 to which a side wall designated by the numeral 2 is foldably joined along a fold line 3. A bottom wall 4 as shown in FIGS. 2 and 3 is foldably joined to side wall 2 along fold line 5 and to the side wall opposite from side wall 2 which is not observable in the drawings.

The closure panels for both ends of the carton are identical. As is apparent from FIG. 1, panel 6 is foldably joined to side wall 2 along fold line 7 while panel 8 is foldably joined along fold line 9 to the side wall opposite from that designated by numeral 2. End flap 10 is foldably joined to top wall 1 along fold line 11 while end flap 12 is foldably joined to bottom wall 4 along fold line 13. Flaps 6, 8, 10 and 13 are secured in overlapping relation by known means to form an end closure for the carton.

Figure 3:
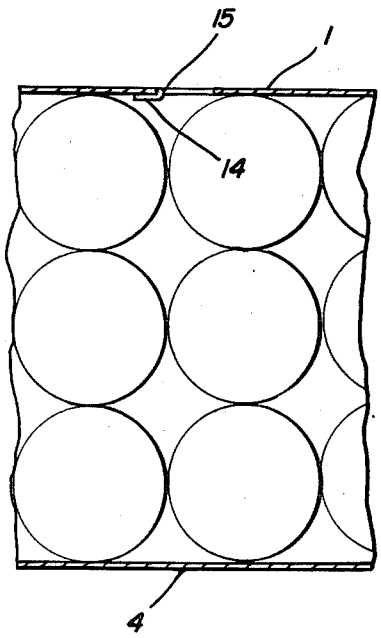
FIG. 3 is a view similar to FIG. 2 but which indicates a different orientation of the handle flap following folding of the flap into its carton carrying position.
Figure 2:
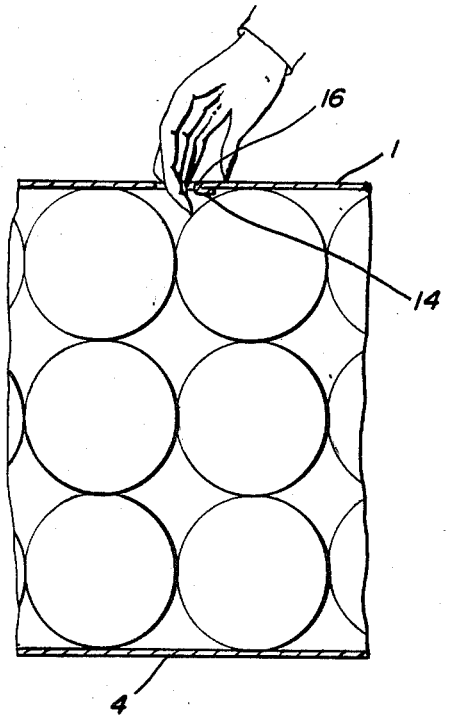
FIG. 2 is a cross sectional view taken along the line designated 2—2 in FIG. 1.
Figure 4:
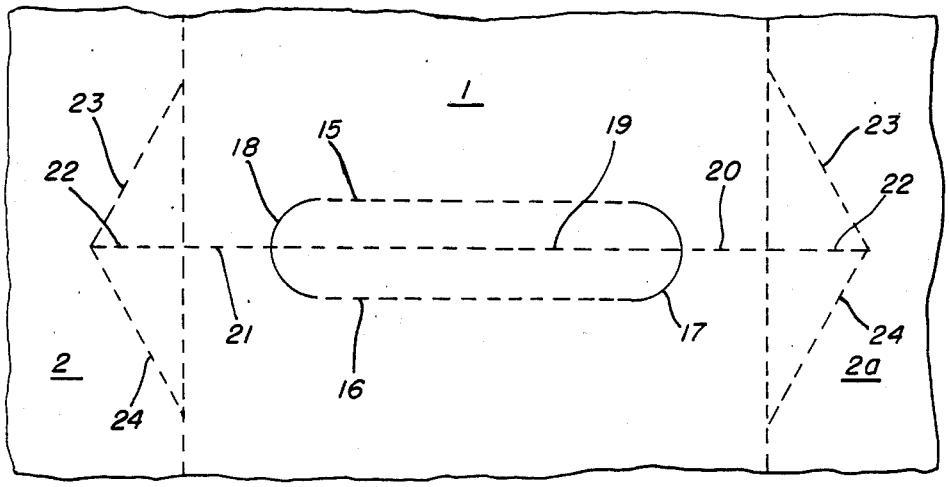
FIG. 4 is an overhead view of the invention.

As is apparent from FIGS. 2 and 3, three rows or tiers of four cans each are disposed within the carton and arranged with their axes horizontal and in parallel relation to each other.

With reference to FIG. 1 a transverse handle flap generally designated by the numeral 14 is formed in top wall 1. Handle flap 14 is defined by a pair of parallel side edges 15 and 16 together with a pair of arcuate end slits 17 and 18. A longitudinal medial fold line 19 is formed in handle flap 14.

According to one form of the invention, side edge 15 of flap 14 is defined by a perforated severance line while the side edge 16 is defined by a fold line so that downward pressure on flap 14 adjacent severance line 15 ruptures that line and allows the entire flap 14 to be folded downwardly and generally to the right to cause flap 14 to occupy the position shown in FIG. 2.

According to one feature of this invention, both sides 15 and 16 of the flap 14 may be defined by perforated severance slits either of which may function to sever the associated edge of the flap 14 from top wall 1 and the other of which may function as a fold line.

Disposed in top panel 1 and interconnected at approximately the mid point of each arcuate slit 17 and 18 are stress relieving slits 20 and 21. Each of these stress relieving slits extends into the adjacent side wall as indicated at 22 in connection with stress relieving slit 21. Also the lower end of each stress relieving slit such as 22 formed in one of the side walls is interconnected by a pair of weakened fold lines such as 23 and 24 with the fold line such as 3 between a side wall and the top wall. Of course similar structure to elements 22–24 is formed in the side wall **2*a* which is opposite the side wall 2. The point of intersection of the stress relieving slit such as 22 with the junction such as 3 between top wall 1 and each of the side walls such as 2 is offset longitudinally from the severance line defining a side edge of the handle flap 14** so as to facilitate dispersal of stress in the side walls and thereby to minimize the possibility of tearing of the side walls.

As shown in FIG. 2, the edge 15 of flap 14 is defined by a weakened severance line while the edge 16 of flap 14 is defined by a fold line. As represented in FIG. 3, the side edge 16 of flap 14 is defined by a severance line while the edge 15 of flap 14 functions as a fold line.

In manipulating the handle flap 14, it may be desirable to collapse the flap 14 along its medial fold line 19. Of course such an arrangement would produce a different cross sectional view from those represented in FIGS. 2 and 3 as is obvious. Such a folding of flap 14 would add strength to the flap and for some applications of the invention may prove desirable. Ordinarily the entire flap 14 is folded as a unit without being collapsed and as represented in FIGS. 2 and 3. When so folded it is obvious that the entire flap 14 defined by edges 15, 16 and arcuate slits 17 and 18 is manipulated as a unit and the entire structure serves as reinforcement for the top wall 1 and such folding also provides a wide opening for comfortably receiving the fingers of the user.

INDUSTRIAL APPLICABILITY

By this invention, an efficient, strong and versatile carrying handle for a can carton is provided.

We claim:

1. A carrying handle for a carton for packaging a plurality of articles such as cylindrical cans arranged in at least one tier of cans whose axes are horizontal and having interconnected top, bottom and side walls and end closure panels, said handle comprising a transverse flap formed in said top wall approximately midway between two adjacent cans and having a pair of spaced transverse generally parallel side edges along at least one of which said flap is severable and the other of which is arranged to function as a flap fold line and the ends of said flap being defined by a pair of end slits arranged to interconnect adjacent ends of said side edges respectively, said flap being folded inwardly along said flap fold line to position the entire area of said flap in flat face contacting relation with the inner surface of said top wall and to form a finger receiving aperture in said top wall and to reinforce said top wall and a stress relieving slit formed in each side wall and intersecting the junction between each side wall and the top wall at a point of intersection aligned longitudinally with a part of said transverse flap intermediate its side edges, each stress relieving slit extending from the respective point of intersection to a point on one of said end slits intermediate said side edges.

2. A carrying handle according to claim 1 wherein both of said side edges of said flap are defined by perforated slits each of which is arranged to function as a severance line or as a fold line.

3. A carrying handle according to claim 1 wherein a medial fold line is formed in said flap.

4. A carrying handle according to claim 1 wherein each of said end slits is of arcuate configuration.

5. A carrying handle according to claim 1 wherein said pair of stress relieving slits are formed in said top wall and extend respectively from said end slits into the adjacent side wall.

6. A carrying handle according to claim 5 wherein each of said stress relieving slits intersects the associated end slit at approximately the mid point thereof.

7. A carrying handle for a can carton for packaging a plurality of cylindrical cans arranged in at least one tier of cans whose axes are horizontal and having a unitary top wall interconnected with side walls, said handle comprising a transverse handle flap formed in the top wall approximately midway between two adjacent cans and including spaced transverse side edges whose adjacent ends are interconnected by end slits respectively, one side edge of said handle flap being defined by a perforated severance line and the opposite side edge of the handle flap being defined by a fold line, and a stress relieving perforated slit formed in each of said side walls and having one end in communication with an adjacent one of said end slits at a point spaced a substantial distance from said severance line, each of said stress relieving slits being arranged so that it intersects the junction between the associated side wall and the top wall is at a point offset longitudinally from said severance line.

* * * * *